US007834811B2

(12) United States Patent
Chen et al.

(10) Patent No.: US 7,834,811 B2
(45) Date of Patent: Nov. 16, 2010

(54) ANTENNA MODULE AND ELECTRONIC DEVICE USING THE SAME

(75) Inventors: Yun-Ta Chen, Taoyuan (TW); Yen-Liang Kuo, Taoyuan (TW); Tsung-Ying Tsai, Taoyuan (TW)

(73) Assignee: HTC Corporation, Taoyuan, Taoyuan County (TW)

( * ) Notice: Subject to any disclaimer, the term of this patent is extended or adjusted under 35 U.S.C. 154(b) by 198 days.

(21) Appl. No.: 12/136,100

(22) Filed: Jun. 10, 2008

(65) Prior Publication Data

US 2009/0033570 A1 Feb. 5, 2009

(30) Foreign Application Priority Data

Jul. 30, 2007 (TW) ..... 96127848 A

(51) Int. Cl.
*H01Q 1/24* (2006.01)

(52) U.S. Cl. ..... 343/702; 343/846

(58) Field of Classification Search ..... 343/702, 343/741, 866, 846
See application file for complete search history.

(56) References Cited

U.S. PATENT DOCUMENTS 5,537,123 A * 7/1996 Mandai et al. ..... 343/700 MS
5,767,813 A * 6/1998 Verma et al. ..... 343/744
6,011,517 A * 1/2000 Skurski ..... 343/702
7,034,752 B2 * 4/2006 Sekiguchi et al. ..... 343/700 MS
7,236,133 B2 * 6/2007 Ohara ..... 343/702
7,319,433 B2 * 1/2008 Rosenberg et al. ..... 343/702

FOREIGN PATENT DOCUMENTS

| | | |
|---|---|---|
| JP | 2006-129431 | 5/2006 |
| TW | 504859 | 10/2002 |
| TW | 251956 | 3/2006 |
| TW | 273740 | 2/2007 |

OTHER PUBLICATIONS

English language translation of abstract of TW 504859 (published Oct. 1, 2002).
English language translation of abstract of TW I251956 (pp. 3-5 of publication, published Mar. 21, 2006).
English language translation of abstract of JP 2006-129431 (published May 18, 2006).
English language translation of abstract of TW I273740 (published Feb. 11, 2007).
Hayashida, S., et al.; "Built-In Folded Monopole Antenna for Handsets;" Electronics Letters, vol. 40, Issue 24; 2004; pp. 1514-1516.
Chen, A.C., et al.; "A Loop Antenna for WLAN Application;" Microwave Conference Proceedings; 2005; pp. 1-4.

* cited by examiner

*Primary Examiner*—Hoang V Nguyen
(74) *Attorney, Agent, or Firm*—Thomas, Kayden, Horstemeyer & Risley

(57) ABSTRACT

An antenna module and an electronic device using the same. The antenna module includes a metal body bent from a I strip metal sheet. The metal body includes a first connecting part, a second connecting part and a plurality of bending parts. The first connecting part and the second connecting part are coupled to a circuit board. The bending parts are formed between the first connecting part and the second connecting part.

35 Claims, 6 Drawing Sheets

ANTENNA MODULE AND ELECTRONIC DEVICE USING THE SAME

This application claims the benefit of Taiwan application Serial No. 96127848, filed Jul. 30, 2007, the subject matter of which is incorporated herein by reference.

BACKGROUND OF THE INVENTION

1. Field of the Invention

The invention relates in general to an antenna module and an electronic device using the same, and more particularly to an antenna module formed with a plurality of bending parts, and an electronic device using the same.

2. Description of the Related Art

In the age of the changing technological development with each passing day, a portable electronic device has become an indispensable part in the daily life of the modern human beings. More particularly, the electronic device, such as a personal digital assistant phone (PDA Phone), a personal digital assistant (PDA), a smart phone or a mobile phone, for receiving a wireless local area network (WLAN) signal or a Bluetooth signal, has the miniaturized property and the mobile property. So, the user can momentarily communicate with others via a cell or perform data processing in a quite convenient manner at any place. In the conventional electronic device for receiving the WLAN signal or the Bluetooth signal, an antenna module thereof may be a chip antenna or a monopole antenna.

FIG. 1A (Prior Art) is a schematic illustration showing a conventional chip antenna 130. The chip antenna 130 is disposed on a circuit board 140 and it may be hidden inside a housing to keep the completeness of the exterior design of the housing. However, the chip antenna 130 is formed by the low-temperature co-fired ceramics (LTCC) technology and the manufacturing processes thereof are more complicated so that the product cost is significantly increased. In addition, the typical chip antenna 130 is composed of a medium with a high medium constant. Thus, the antenna performance has the problems of the narrow bandwidth, the low efficiency and the low gain.

FIG. 1B (Prior Art) is a schematic illustration showing a conventional monopole antenna 110. The monopole antenna 110 is vertically disposed on a circuit board 120. The monopole antenna 110 includes a radiation body 111 and a feeding portion 112. The feeding portion 112 is coupled to a feeding connection point 121 of the circuit board 120. As shown in FIG. 1B, a length Wh110*a*, a width W110*b* and a height W110*c* of the monopole antenna 110 are about 7 mm×0.2 mm×30 mm, and the monopole antenna 110 is for receiving the WLAN signal or the Bluetooth signal with the frequency band of 2.4 GHz, for example. Typically, the volume of the monopole antenna 110 is big and occupies a lot of space so that the size of the electronic device cannot be reduced.

SUMMARY OF THE INVENTION

The invention is directed to an antenna module and an electronic device using the same, in which a structure with a plurality of bending parts is designed so that the antenna module only occupying a small space can receive signals with a predetermined frequency band, and the objects of the miniaturization and the high efficiency can be achieved.

According to a first aspect of the present invention, an antenna module is provided. The antenna module includes a metal body bent from a strip metal sheet. The metal body comprises a first connecting part, a second connecting part and a plurality of bending parts. The first connecting part is to be coupled to a circuit board. The bending parts are formed between the first connecting part and the second connecting part.

According to a second aspect of the present invention, an electronic device is provided. The electronic device includes a circuit board and an antenna module. The antenna module is electrically connected to the circuit board. The antenna module includes a metal body bent from a strip metal sheet. The metal body includes a first connecting part, a second connecting part and a plurality of bending parts. The first connecting part and the second connecting part are coupled to the circuit board. The bending parts are formed between the first connecting part and the second connecting part.

According to a third aspect of the present invention, an electronic device is provided. The electronic device includes a circuit board and an antenna module. The circuit board has a feeding bonding pad and a fixed bonding pad. The antenna module is electrically connected to the circuit board. The antenna module includes a metal body. The metal body is bent from a strip metal sheet. The metal body includes a first connecting part, a second connecting part, a first bending part, a second bending part, a first radiation metal sheet, a second radiation metal sheet and a third radiation metal sheet. The first connecting part has a first extending plate and lies on the feeding bonding pad. The second connecting part has a second extending plate and lies on the fixed bonding pad. The first bending part and the second bending part are formed between the first connecting part and the second connecting part. The first radiation metal sheet is coupled to the first connecting part. The second radiation metal sheet is substantially vertically coupled to the first radiation metal sheet. The third radiation metal sheet is coupled between the second radiation metal sheet and the second connecting part, and is substantially perpendicular to the second radiation metal sheet. The first bending part and the second bending part are respectively bent between the first radiation metal sheet and the second radiation metal sheet, and between the second radiation metal sheet and the third radiation metal sheet.

The invention will become apparent from the following detailed description of the preferred but non-limiting embodiment. The following description is made with reference to the accompanying drawings.

DETAILED-DESCRIPTION OF THE INVENTION

Figure 1A:
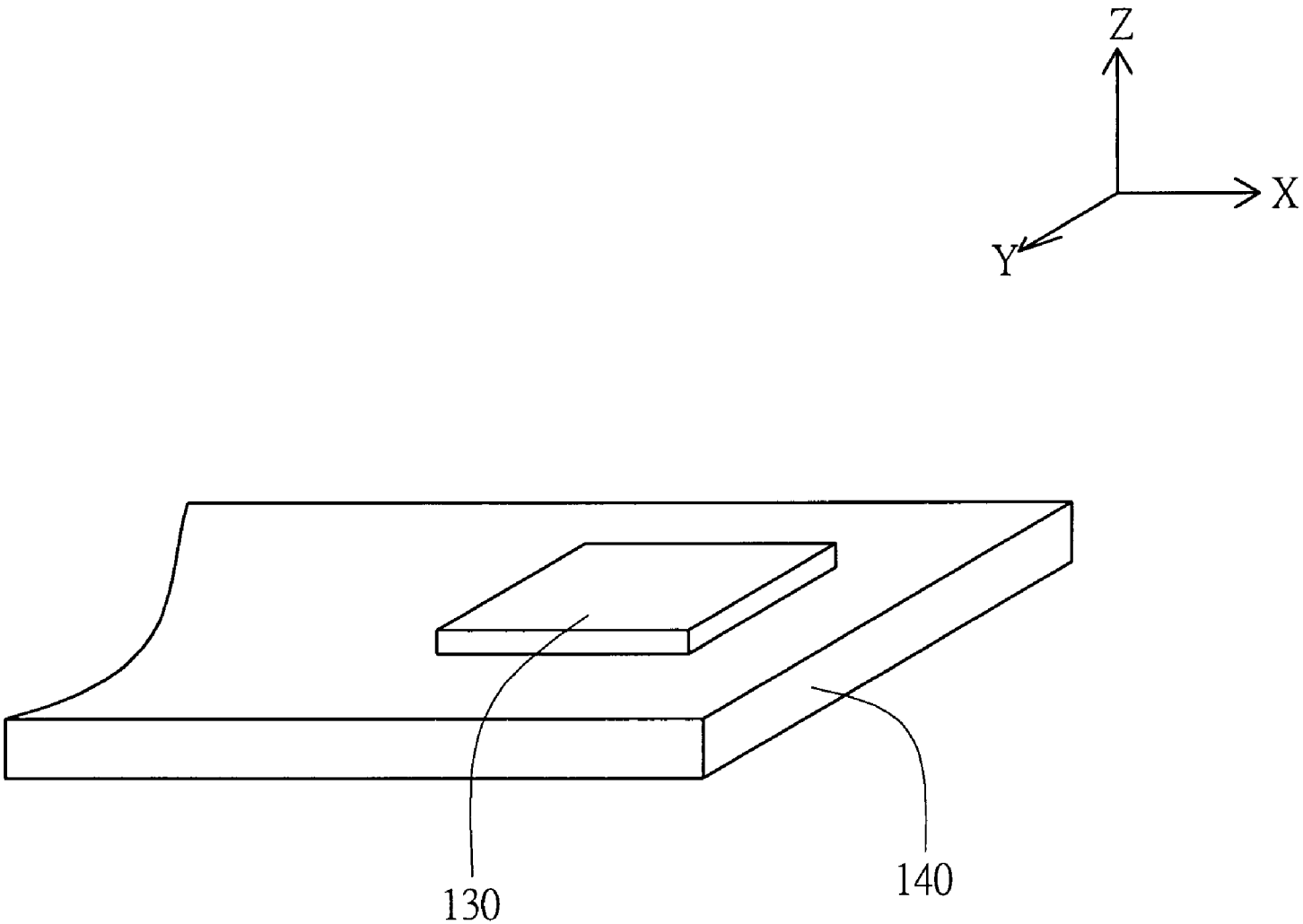
FIG. 1A(PRIOR ART)
FIG. 1A is a schematic illustration showing a conventional chip antenna.
Figure 1B:
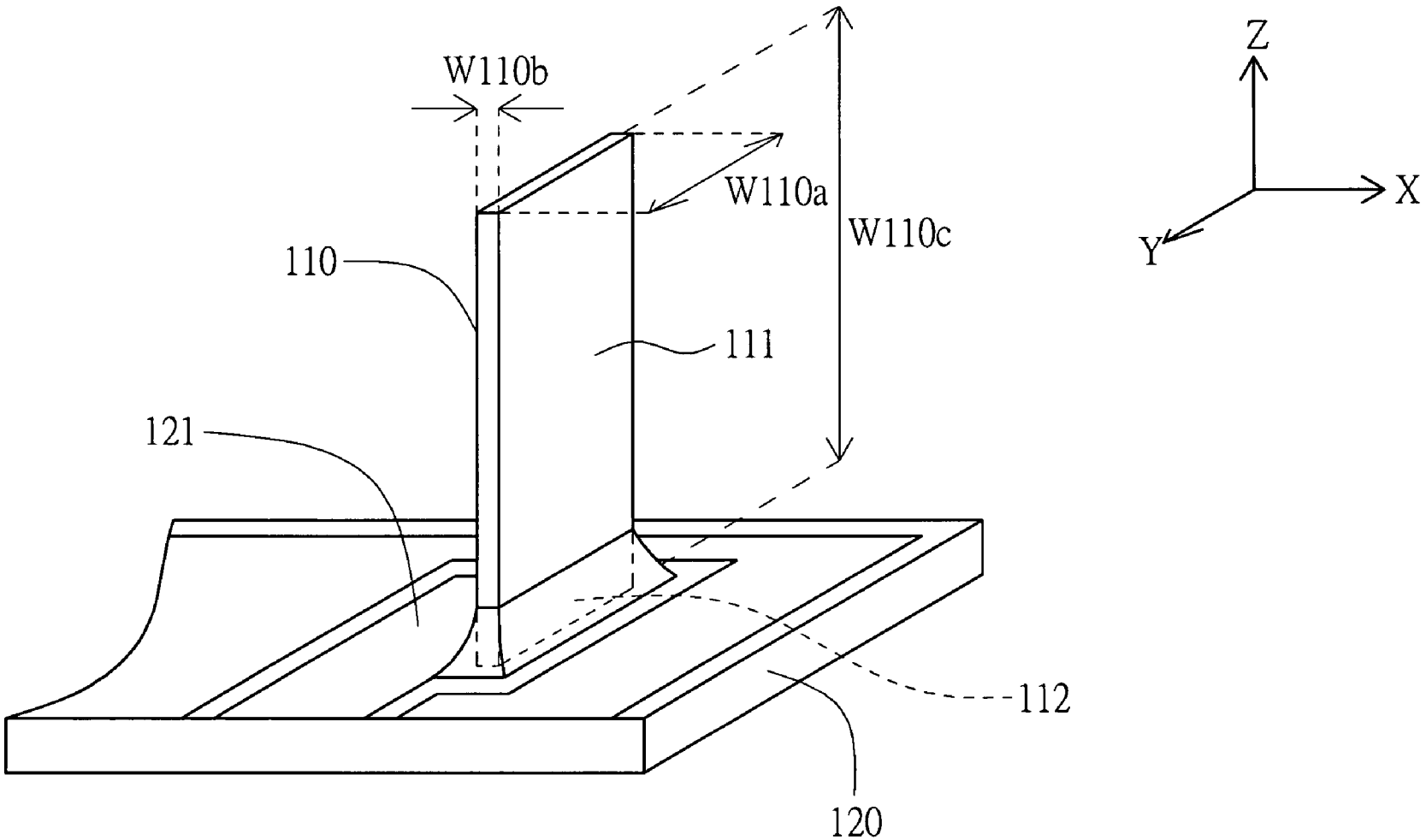
FIG. 1B(PRIOR ART)
FIG. 1B is a schematic illustration showing a conventional monopole antenna.
Figure 2:
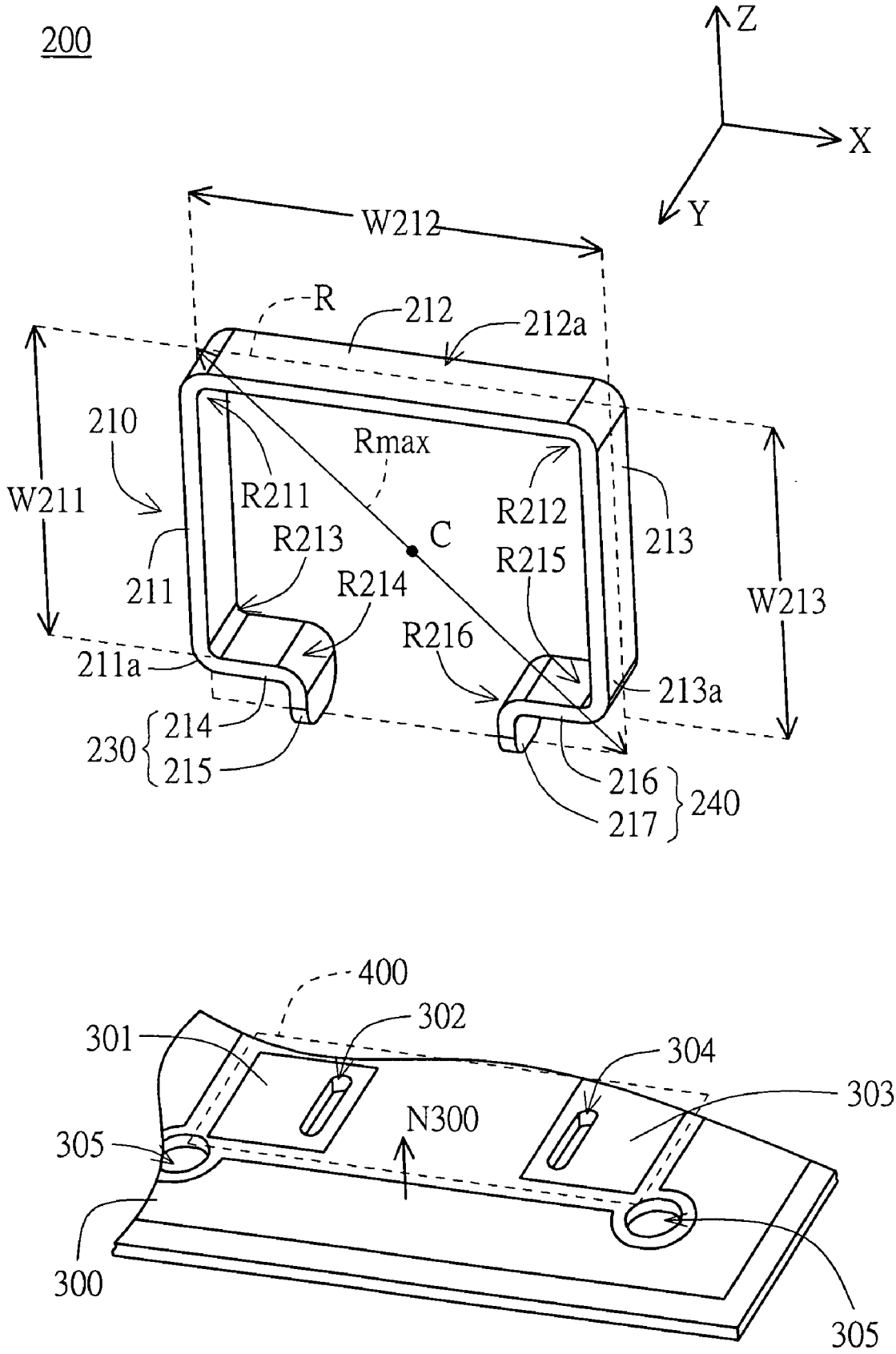
FIG. 2 is a schematic illustration showing an antenna module according to a preferred embodiment of the invention.

FIG. 2 is a schematic illustration showing an antenna module 200 according to a preferred embodiment of the invention. Referring to FIG. 2, the antenna module 200 includes a metal body 210. The antenna module 200 is a monopole antenna, and the metal body 210 thereof is bent from a one-piece molded strip metal sheet. In this embodiment, the strip metal sheet is made of copper, and a nickel layer may be coated on to serve as an anti-oxidation layer to prevent the metal body 210 from oxidizing. The metal body 210 includes a first connecting part, a second connecting part and a plurality of bending parts. In this embodiment, the first connecting part is a feeding portion 230, and the second connecting part is a fixing portion 240. The bending parts are formed between the first connecting part and the second connecting part. The bending part of this embodiment includes first to sixth bending parts R211 to R216. The metal body 210 is with the bending parts surrounding a center point C and disposed within a predetermined range R. A maximum radial length Rmax of the predetermined range R is smaller than a length of the metal body 210 so that the antenna module 200 occupies the smaller space.

In this embodiment, the antenna module 200 is for receiving a wireless local area network (WLAN) signal or a Bluetooth signal having the frequency band of about 2.4 GHz, for example. However, the different kind signals and the frequency bands received by the antenna module 200 do not intend to limit the technological range of the invention. The antenna module 200 of the invention is bent from a plurality of bending parts. Thus, compared with the conventional monopole antenna, the antenna module 200 of the invention can greatly reduce the occupied space.

Referring to FIG. 2, the metal body 210 includes a first radiation metal sheet 211, a second radiation metal sheet 212, a third radiation metal sheet 213, a first bending part R211 and a second bending part R212. The first radiation metal sheet 211, the second radiation metal sheet 212, the third radiation metal sheet 213, the first bending part R211 and the second bending part R212 are integrally formed. The second radiation metal sheet 212 is substantially vertically coupled to the first radiation metal sheet 211, and the third radiation metal sheet 213 is substantially vertically coupled to the second radiation metal sheet 212 to form an inverse-U shaped structure. As shown in FIG. 2, the first radiation metal sheet 211 and the third radiation metal sheet 213 are arranged along a Z-axis direction, and the second radiation metal sheet 212 is arranged along an X-axis direction. The first bending part R211 and the second bending part R212 are respectively bent between the first radiation metal sheet 211 and the second radiation metal sheet 212, and between the second radiation metal sheet 212 and the third radiation metal sheet 213. A length W211 of the first radiation metal sheet 211 is substantially equal to a length W213 of the third radiation metal sheet 213.

The length W211 of the first radiation metal sheet 211 and the length W213 of the third radiation metal sheet 213 in the antenna module 200 of this embodiment are substantially equal to 5.5 mm, and a length W212 of the second radiation metal sheet 212 is about 7.5 mm so that the signal with the frequency band of 2.4 GHz can be received and the size of the antenna module 200 approximates to that of the chip antenna for receiving the same frequency band of signal. Thus, the antenna module 200 can be directly disposed at the position of the original chip antenna without additionally modifying the original structure of the electronic device.

Preferably, the antenna module 200 is a surface mount device (SMD). The second radiation metal sheet 212 has a adhesive platen 212*a* to be mounted by an automation apparatus to perform a surface mount process and the antenna module 200 can be disposed on a circuit board 300 through the automatic surface mount process with the shortened processing time and the increased throughput.

As shown in FIG. 2, the first radiation metal sheet 211 and the third radiation metal sheet 213 are substantially parallel to a normal direction N300 of the circuit board 300 so that the metal body 210 stands upright on the circuit board 300. Thus, the better shape of radiation filed can be obtained and the radiation property of an omni antenna can be obtained.

A projection region 400 obtained by projecting the antenna module 200 onto the circuit board 300 does not has a ground trace. That is, the antenna module 200 is not overlapped with the ground trace. Thus, the ground trace would not influence the efficiency of the antenna module 200. Furthermore, how the metal body 210 is disposed on the circuit board 300 will be described in the following.

The feeding portion 230 of the metal body 210 is disposed on an end portion 211*a* of the first radiation metal sheet 211 and is to be electrically connected to the circuit board 300. The feeding portion 230 includes a first extending plate 214 and a second extending plate 215. The first extending plate 214 substantially vertically coupled to the end portion 211*a* of the first radiation metal sheet 211 and lies on a feeding bonding pad 301 of the circuit board 300. A transmission signal is fed from the feeding bonding pad 301 to the metal body 210 of the antenna module 200. The second extending plate 215 is substantially vertically coupled to the first extending plate 214 and inserted into a feeding bonding hole 302 of the circuit board 300. A third bending part R213 is bent between the first radiation metal sheet 211 and the first extending plate 214. A fourth bending part R214 is bent between the first extending plate 214 and the second extending plate 215.

The fixing portion 240 of the metal body 210 is disposed at one end portion 213*a* of the third radiation metal sheet 213 and is bonded to the circuit board 300. The fixing portion 240 includes a third extending plate 216 and a fourth extending plate 217. The third extending plate 216 substantially vertically coupled to the end portion 213*a* of the third radiation metal sheet 213 and lies on a fixed bonding pad 303 of the circuit board 300. The fourth extending plate 217 is substantially vertically coupled to the third extending plate 216 and inserted into a fixed bonding hole 304 of the circuit board 300. A fifth bending part R215 is bent between the third radiation metal sheet 213 and the third extending plate 216, and a sixth bending part R216 is bent between the third extending plate 216 and the fourth extending plate 217.

Figure 3:
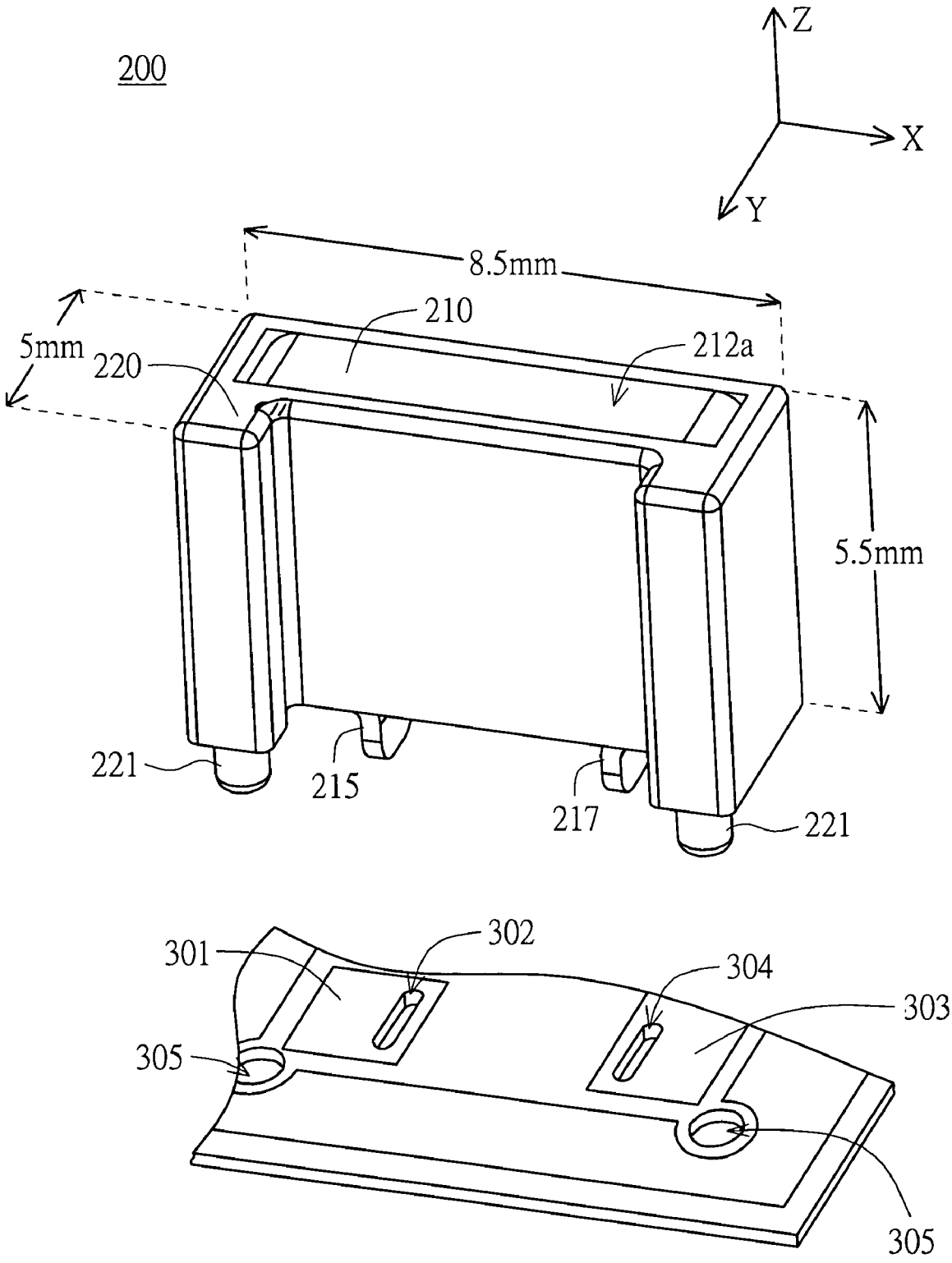
FIG. 3 is a schematic illustration showing a metal body of FIG. 2 covering an outer frame.

FIG. 3 is a schematic illustration showing the metal body of FIG. 2 covering an outer frame. Referring to FIG. 3, the antenna module 200 further includes an outer frame 220, which covers the metal body 210 and is for intensifying a structure strength of the antenna module 200. As shown in FIG. 3, after the antenna module 200 is covered by the outer frame 220, the length thereof is about 8.5 mm, the width thereof is about 5.5 mm, and the height thereof is about 5 mm. The outer frame 220 includes two positioning projections 221 to be respectively inserted into two positioning through holes 305 of the circuit board 300.

Figure 4:
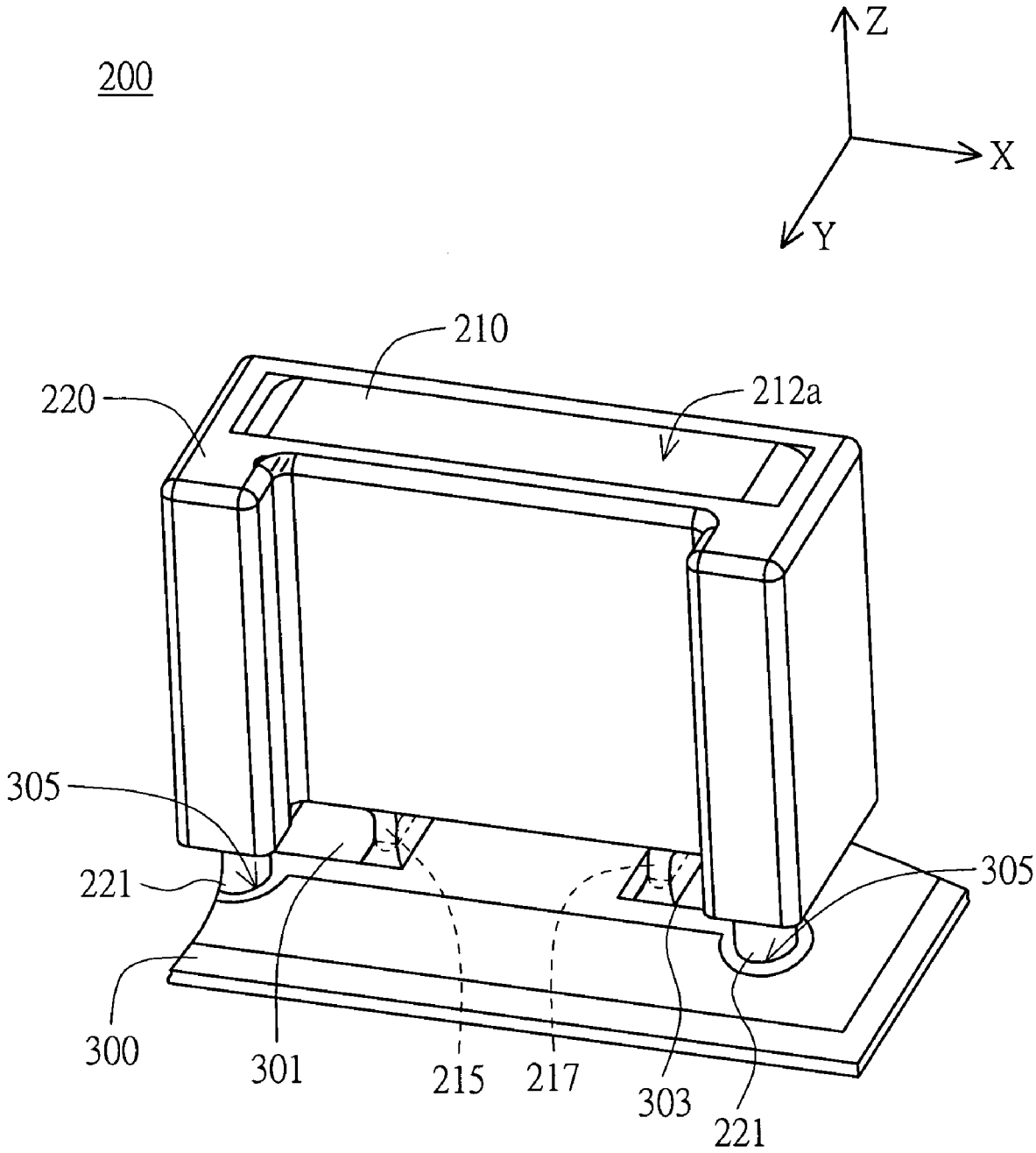
FIG. 4 is a schematic illustration showing the antenna module of FIG. 3 disposed on a circuit board.

FIG. 4 is a schematic illustration showing the antenna module of FIG. 3 disposed on a circuit board. In the automatic surface mount process, a solder paste is firstly printed on the feeding bonding pad 301 and the fixed bonding pad 303 of the circuit board 300. Next, an automation apparatus, such as a placer, sucking the adhesive platen 212*a* of the antenna module 200 with a robot arm, and placing the antenna module 200 on the circuit board 300. The positioning projection 221 of the antenna module 200 is inserted into the positioning through hole 305, and the second extending plate 215 and the fourth extending plate 217 are respectively inserted into the feeding bonding hole 302 and the fixed bonding hole 304. Meanwhile, the first extending plate 214 and the third extending plate 216 are adhered to the solder paste. After a reflow process is performed, the metal body 210 is firmly bonded to the circuit board 300.

Figure 5:
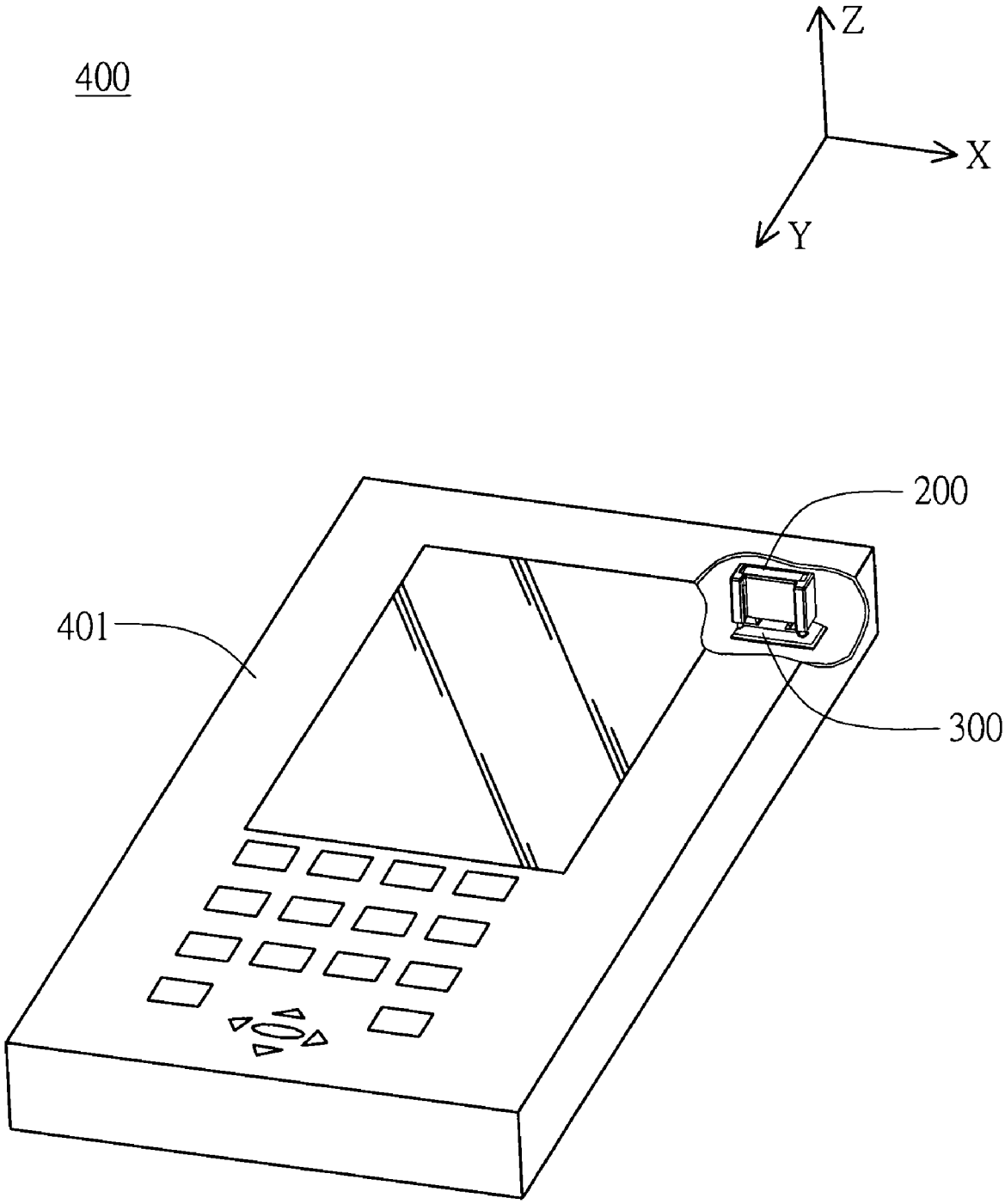
FIG. 5 is a schematic illustration showing an electronic device using the antenna module of this embodiment.

FIG. 5 is a schematic illustration showing an electronic device using the antenna module of this embodiment. The antenna module 200 of this embodiment may be applied to an electronic device 400, such as a personal digital assistant phone (PDA Phone), a personal digital assistant (PDA), a smart phone or a mobile phone. The antenna module 200 may be hidden inside a housing 410 without projecting out of the housing 410, and the space occupied by the antenna module 200 is small. In this embodiment, the antenna module (containing the outer frame) 200 only needs the space of 8.5 mm×5.5 mm×5 mm and can receive the signal with the bandwidth of 2.4 GHz. So, a lot of space is saved.

According to the above-mentioned embodiment, the metal body 210 of the invention has two bending parts, which form an inverse-U shaped structure. However, the metal body 210 may also have a plurality of bending parts, which may form various shapes of structures. As long as the metal body has a plurality of bending parts formed within a predetermined range so that the occupied space can be reduced and the signal with the predetermined frequency band can be received, this design is still deemed as falling within the technological range of the invention.

According to the above-mentioned embodiment, the length W211 of the first radiation metal sheet 211 and the length W213 of the third radiation metal sheet 213 are equal to 5.5 mm, and the length W212 of the second radiation metal sheet 212 is equal to 7.5 mm, for example. However, the lengths of the first radiation metal sheet 211, the second radiation metal sheet 212 and the third radiation metal sheet 213 according to this invention may also be adjusted in response to the different frequency bands of signals so that the object of receiving the signal with the predetermined frequency band can be achieved. Any dimensional variations of the first radiation metal sheet 211, the second radiation metal sheet 212 and the third radiation metal sheet 213 are still deemed as falling within the technological range of the invention.

In the antenna module and the electronic device using the same according to the above-mentioned embodiment of the invention, the metal body thereof has a plurality of bending parts formed within a predetermined range and the other associated structure designs make the antenna module and the electronic device using the same have the following advantages.

First, the metal body of the antenna module of the invention is formed within the predetermined range, and the maximum radial length of the predetermined range is far shorter than the length of the metal body so that the space occupied by the antenna module is greatly reduced. In addition, the size of the antenna module is very close to that of the chip antenna for receiving the same frequency band of signal. So, the antenna module can be directly disposed at the original position of the chip antenna without additionally modifying the structure design of the electronic device.

Second, the metal body of the antenna module of the invention is simply composed of metal. So, the impedance bandwidth and the antenna gain of the antenna module are better than those of the conventional chip antenna. In addition, the antenna module of the invention is vertically disposed on the circuit board, and with the radiation property of the omni antenna so that the signal receiving quality of the product can be enhance.

Third, the antenna module of the invention can be disposed on the circuit board by the automatic surface mount process so that the time can be shortened and the throughput can be increased.

Fourth, the second extending plate and the fourth extending plate of the metal body of the antenna module of the invention are respectively inserted into the feeding bonding hole and the fixed bonding hole, and the positioning projection of the outer frame is inserted into the positioning through hole. So, the antenna module can withstand the strong impact caused by falling down, for example, and the structure strength thereof is also significantly enhanced.

Fifth, the metal body of the antenna module of the invention is made of metal, so the cost thereof is low, and the manufacturing cost can be greatly reduced.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna module, comprising:

a metal body, which is bent from a strip metal sheet and comprises:

a first connecting part and a second connecting part to be coupled to a circuit board including a ground trace; and a plurality of bending parts formed between the first connecting part and the second connecting part, wherein a projection of the antenna module is not overlapped with the ground trace when the first connecting part and the second connecting part is coupled to the circuit board.

2. The antenna module according to claim 1, wherein the plurality of bending parts comprises a first bending part and a second bending part, and the metal body further comprises:

a first radiation metal sheet coupled to the first connecting part;

a second radiation metal sheet coupled to the first radiation metal sheet; and a third radiation metal sheet coupled between the second radiation metal sheet and the second connecting part, wherein the first bending part is bent between the first radiation metal sheet and the second radiation metal sheet, and the second bending part is bent between the second radiation metal sheet and the third radiation metal sheet.

3. The antenna module according to claim 2, wherein the second radiation metal sheet is substantially vertically coupled to the first radiation metal sheet, and the third radiation metal sheet is substantially vertically coupled to the second radiation metal sheet.

4. The antenna module according to claim 3, wherein the first radiation metal sheet, the second radiation metal sheet and the third radiation metal sheet substantially form an inverse-U shape.

5. The antenna module according to claim 2, wherein a length of the first radiation metal sheet is substantially equal to a length of the third radiation metal sheet.

6. The antenna module according to claim 2, which being for receiving a wireless local area network (WLAN) signal or a Bluetooth signal.

7. The antenna module according to claim 6, wherein a length of each of the first radiation metal sheet and the third radiation metal sheet is substantially equal to 5.5 mm, and a length of the second radiation metal sheet is substantially equal to 7.5 mm.

8. The antenna module according to claim 2, wherein the first radiation metal sheet and the third radiation metal sheet are substantially parallel to a normal direction of the circuit board.

9. The antenna module according to claim 2, wherein the first connecting part has a first extending plate, which lies on a feeding bonding pad of the circuit board; and the plurality of bending parts further comprises a third bending part, which is bent between the first radiation metal sheet and the first extending plate.

10. The antenna module according to claim 9, wherein the first connecting part further has a second extending plate to be inserted into a feeding bonding hole of the circuit board; and the plurality of bending parts further comprises a fourth bending part bent between the first extending plate and the second extending plate.

11. The antenna module according to claim 2, wherein the second connecting part has a third extending plate, which lies on a fixed bonding pad of the circuit board; and the plurality of bending parts further comprises a fifth bending part bent between the third radiation metal sheet and the third extending plate.

12. The antenna module according to claim 11, wherein the second connecting part further has a fourth extending plate to be inserted into a fixed bonding hole of the circuit board; and the plurality of bending parts further comprises a sixth bending part bent between the third extending plate and the fourth extending plate.

13. The antenna module according to claim 2, which being a surface mount device (SMD), wherein the second radiation metal sheet has an adhesive platen to be mounted by an automation apparatus to perform a surface mount process.

14. The antenna module according to claim 2, further comprising: an outer frame, covering the metal body, for intensifying the antenna module.

15. The antenna module according to claim 14, wherein the outer frame comprises two positioning projections to be respectively inserted into two positioning through holes of the circuit board.

16. The antenna module according to claim 1, which being a monopole antenna.

17. An electronic device, comprises:

a circuit board including a ground trace; and an antenna module, which is electrically connected to the circuit board, and comprises a metal body bent from a strip metal sheet, the metal body comprising:

a first connecting part and a second connecting part coupled to the circuit board; and a plurality of bending parts formed between the first connecting part and the second connecting part, wherein a projection of the antenna module is not overlapped with the ground trace.

18. The electronic device according to claim 17, wherein the plurality of bending parts comprises a first bending part and a second bending part, and the metal body further comprises:

a first radiation metal sheet coupled to the first connecting part;

a second radiation metal sheet coupled to the first radiation metal sheet; and a third radiation metal sheet coupled between the second radiation metal sheet and the second connecting part, wherein the first bending part is bent between the first radiation metal sheet and the second radiation metal sheet, and the second bending part is bent between the second radiation metal sheet and the third radiation metal sheet.

19. The electronic device according to claim 18, wherein the second radiation metal sheet is substantially vertically coupled to the first radiation metal sheet, and the third radiation metal sheet is substantially vertically coupled to the second radiation metal sheet.

20. The electronic device according to claim 19, wherein the first radiation metal sheet, the second radiation metal sheet and the third radiation metal sheet substantially form an inverse-U shape.

21. The electronic device according to claim 18, wherein a length of the first radiation metal sheet is substantially equal to a length of the third radiation metal sheet.

22. The electronic device according to claim 18, wherein the antenna module is for receiving a wireless local area network (WLAN) signal or a Bluetooth signal.

23. The electronic device according to claim 22, wherein a length of each of the first radiation metal sheet and the third radiation metal sheet is substantially equal to 5.5 mm, and a length of the second radiation metal sheet is substantially equal to 7.5 mm (mm).

24. The electronic device according to claim 18, wherein the first radiation metal sheet and the third radiation metal sheet are substantially parallel to a normal direction of the circuit board.

25. The electronic device according to claim 18, wherein the circuit board has a feeding bonding pad, the first connecting part has a first extending plate, which lies on the feeding bonding pad, and the plurality of bending parts further comprises a third bending part bent between the first radiation metal sheet and the first extending plate.

26. The electronic device according to claim 25, wherein the circuit board further has a feeding bonding hole, the first connecting part further has a second extending plate to be inserted into the feeding bonding hole, and the plurality of bending parts further comprises a fourth bending part bent between the first extending plate and the second extending plate.

27. The electronic device according to claim 18, wherein the circuit board has a fixed bonding pad, the second connecting part has a third extending plate, which lies on the fixed bonding pad, and the plurality of bending parts further comprises a fifth bending part bent between the third radiation metal sheet and the third extending plate.

28. The electronic device according to claim 27, wherein the circuit board further has a fixed bonding hole, the second connecting part further has a fourth extending plate to be inserted into the fixed bonding hole, and the plurality of bending parts further comprises a sixth bending part bent between the third extending plate and the fourth extending plate.

29. The electronic device according to claim 18, wherein the antenna module is a surface mount device (SMD), and the second radiation metal sheet has an adhesive platen to be mounted by an automation apparatus to perform a surface mount process.

30. The electronic device according to claim 18, wherein the antenna module further comprises:

an outer frame, covering the metal body, for intensifying the antenna module.

31. The electronic device according to claim 30, wherein the circuit board comprises two positioning through holes, and the outer frame comprises two positioning projections respectively inserted into the two positioning through holes of the circuit board.

32. The electronic device according to claim 17, wherein the antenna module is a monopole antenna.

33. An electronic device, comprising:

a circuit board having a feeding bonding pad and a fixed bonding pad; and an antenna module, which is electrically connected to the circuit board, and comprises a metal body bent from a strip metal sheet, the metal body comprising:

a first connecting part, which has a first extending plate and lies on the feeding bonding pad;

a second connecting part, which has a second extending plate and lies on the fixed bonding pad;

a first bending part and a second bending part formed between the first connecting part and the second connecting part;

a first radiation metal sheet coupled to the first connecting part;

a second radiation metal sheet substantially vertically coupled to the first radiation metal sheet; and a third radiation metal sheet, which is coupled between the second radiation metal sheet and the second connecting part, and is substantially perpendicular to the second radiation metal sheet, wherein the first bending part is bent between the first radiation metal sheet and the second radiation metal sheet, the second bending part is bent between the second radiation metal sheet and the third radiation metal sheet, and the antenna module is not overlapped with a ground trace.

34. The electronic device according to claim 33, wherein the first radiation metal sheet, the second radiation metal sheet and the third radiation metal sheet substantially form an inverse-U shape.

35. The electronic device according to claim 34, wherein the circuit board further has a feeding bonding hole and a fixed bonding hole, the first connecting part further has a third extending plate, which is coupled to the first extending plate and inserted into the feeding bonding hole, and the second connecting part further has a fourth extending plate, which is coupled to the second extending plate and inserted into the fixed bonding hole.

* * * * *